US006960260B2

(12) United States Patent
Goto

(10) Patent No.: US 6,960,260 B2
(45) Date of Patent: Nov. 1, 2005

(54) DEVICE FOR APPLYING VARNISH TO ELECTRIC WIRE AND METHOD OF APPLYING VARNISH

(75) Inventor: Yoshihide Goto, Yamagata (JP)

(73) Assignee: Goto Electronic Co., Ltd., Yamagata (JP)

( * ) Notice: Subject to any disclaimer, the term of this patent is extended or adjusted under 35 U.S.C. 154(b) by 0 days.

(21) Appl. No.: 10/766,151

(22) Filed: Jan. 28, 2004

(65) Prior Publication Data

US 2005/0008771 A1 Jan. 13, 2005

(30) Foreign Application Priority Data

Jul. 11, 2003 (JP) ..... 2003-195473

(51) Int. Cl.[7] ..... B05C 5/00

(52) U.S. Cl. ..... 118/325; 118/420; 118/DIG. 19; 118/DIG. 22

(58) Field of Search ..... 118/125, DIG. 18, 118/DIG. 19, DIG. 22, 304, 325, 420, 405; 222/214, 406

(56) References Cited

U.S. PATENT DOCUMENTS 2,867,891 A * 1/1959 Horton et al. ..... 156/148
2,883,306 A * 4/1959 Cotter ..... 427/60
2,910,383 A * 10/1959 Miller et al. ..... 427/358
3,155,543 A * 11/1964 Marzocchi et al. ..... 118/405
3,166,441 A * 1/1965 Rylka ..... 118/325
3,231,414 A * 1/1966 Alexander et al. ..... 427/358
3,730,137 A * 5/1973 Luscher et al. ..... 118/325
4,338,361 A * 7/1982 Lin ..... 427/299
4,393,809 A * 7/1983 Hilker ..... 118/620
5,026,451 A * 6/1991 Trzecieski et al. ..... 156/244.27
5,201,952 A * 4/1993 Yahagi et al. ..... 118/109
6,461,684 B1 * 10/2002 Huang et al. ..... 427/424

FOREIGN PATENT DOCUMENTS

JP 9237525 9/1997

* cited by examiner

*Primary Examiner*—Brenda A. Lamb
(74) *Attorney, Agent, or Firm*—Reising, Ethington, Barnes, Kisselle, P.C.

(57) ABSTRACT

An electric wire 1 is moved in a moving direction at a desired speed. An insulating layer of varnish is formed on the outer surface of the electric wire 1 by a device for applying the varnish. The device includes a rough-like container 2 and dropping means 8. The rough-like container 2 is located below the electric wire 1 in the moving direction. The dropping means 8 is located for the electric wire above the container. A desired quantity of varnish is dropped from the dropping means 8 toward the outer surface of the electric wire 1 through a flow rate adjusting portion. The flow rate of the varnish is adjusted by the flow rate adjusting portion 9.

2 Claims, 3 Drawing Sheets

DEVICE FOR APPLYING VARNISH TO ELECTRIC WIRE AND METHOD OF APPLYING VARNISH

BACKGROUND OF THE INVENTION

1. Field of the Invention

This invention relates to a device and method for applying varnish to an electric wire, and more particularly to a device and method for forming an insulating layer with sure electric and heat insulation by applying a necessary minimum amount of varnish to the outer surface of an electric wire with no change in the mixing rate of resin and solvent in the varnish with good productivity.

2. Description of the Related Art

A previously known method for forming an electric insulating layer or a surface treated layer on the outer surface of an electric wire is to immerse the electric wire in an insulating liquid such as varnish by passing the electric wire through the tank containing the insulating liquid so that the varnish is applied to the outer surface using the viscosity of the varnish to form an insulating layer, and to dry the insulating layer of the varnish by passing the electric wire through a dry furnace so that the insulating layer is baked on the outer surface of the electric wire (see JP-A-9-237525 the contents of which are hereby incorporated by reference)

Another well known method for forming an insulating layer such as varnish on the outer surface of an electric wire is to roll a roller while an electric wire is being in movable contact with the roller, the roller being provided in a tank containing varnish, so that the varnish applied to the roller is applied to the outer surface of the electric wire.

However, in the previous method of forming the insulating layer disclosed in the above reference, the electric wire is immersed in an insulating liquid such as varnish by passing the electric wire through the tank containing the insulating liquid so that the varnish is applied to the outer surface using the viscosity of the varnish to form an insulating layer. Therefore, the varnish is exposed to air from when it is accommodated in the tank to when it is applied to the electric wire. As a result, the solvent mixed into the varnish is vaporized so that the mixing ratio of the resin component to the solvent component in the varnish varies momentarily.

Thus, it was difficult to maintain the viscosity of the varnish continuously to keep the applicability of the varnish to the electric wire effectively. In addition, as described above, the solvent is likely to be volatized so that it is difficult to maintain the quality of the varnish. The performance of insulation may be also lost and cracking is likely to occur, thereby reducing the production yield.

In order to obviate such inconvenience, by measuring the density of the varnish to the solvent and the viscosity of the varnish with passage of time, it was necessary to adjust the density or viscosity of the varnish if the solvent becomes insufficient. Such management or inspection of the density or viscosity of the varnish consumes much labor and time to form the insulating layer of varnish on the outer surface of the electric wire, thereby reducing the production efficiency.

In the above other method of applying the varnish onto the outer surface of the electric wire using the roller, the varnish is excessively stirred by the roller which is rolled in the tank. Further, by rolling of the roller, a certain amount of the varnish flies from the tank into the air, and the flown varnish sinks in the varnish in the tank again. Such repetitive behavior facilitates the vaporization of the varnish. Therefore, like the method of forming the insulating layer as disclosed in the above reference, the mixing rate of the resin component to the solvent component in the varnish is likely to vary. Accordingly, it is difficult to validate the applicability of the varnish to the electric wire by e.g. maintaining the viscosity of the varnish in an easily applicable state, and maintain the quality of the varnish. As a result, the varnish applied to the outer surface of the electric wire lacks an insulting performance, is apt to crack, which results in the product with low production yield.

Additionally, when the roller is rolling as described, air is mixed into the varnish to generate air bubbles. Therefore, pin holes were apt to occur in the insulating layer of the varnish applied to the outer surface of the electric wire. Further, the varnish is not applied to have a uniform thickness but applied unevenly. This generates cracks so that the insulating layer is apt to deteriorate, thereby loosing the electric insulation and heat insulation performance.

SUMMARY OF THE INVENTION

An object of this invention is to provide a device and method for applying varnish to an electric wire, which provides a little amount of solvent which volatizes with passage of time so that the mixing rate of resin component to the solvent component in the varnish is always maintained constant to maintain the viscosity of the varnish, thereby providing sufficient applicability to the electric wire, can maintain the quality of the varnish to make it difficult to generate pin holes, cracks, etc., provides excellent electric and heat insulation performance, can easily manage and inspect the quality of the varnish to provide improved production yield and production efficiency, and provides a simple structure which can be easily handled with reduced production cost.

In order to attain the above object, in accordance with this invention, there is provided a device for applying varnish to an electric wire, comprising:

a trough-like container located below the electric wire in the prescribed moving direction; and varnish dropping means including a tank for storing the vanish, a supplying tube which is communicated with the tank and through which the varnish is supplied and a flow-rate adjusting means for adjusting the flow-rate of the varnish to be dropped, wherein the electric wire is movable in a prescribed moving direction at a prescribed speed, and the varnish dropping means drops a desired quantity of varnish toward the outer surface of the electric wire which is moving at the prescribed speed through the flow-rate adjusting means so that an insulating layer of varnish having a uniform thickness is formed on the outer surface of the electric wire.

This device is realized by a method of applying varnish on an electric wire comprising the steps of:

moving an electric wire in a prescribed direction at a predetermined speed;

dropping a prescribed quantity of varnish toward the electric wire, the prescribed quantity of varnish being adjusted using a nozzle; and applying the varnish onto the outer surface of the electric wire to from an insulating layer of the varnish having a uniform thickness.

Such configurations can provide a little amount of solvent which volatizes with passage of time so that the mixing rate of resin component to the solvent component in the varnish is always maintained constant to maintain the viscosity of the varnish, thereby providing sufficient applicability to the electric wire, can maintain the quality of the varnish to make it difficult to generate pin holes, cracks, etc., provides excellent electric and heat insulation performance, can easily manage and inspect the quality of the varnish to provide improved production yield and production efficiency, and provides a simple structure which can be easily handled with reduced production cost.

In the above configurations, preferably, the electric wire is moved at a speed of 3–120 m/minute, and the varnish is composed of the resin component which is a compound of one or two kinds of resins of polyamide, epoxy, polyimide, etc. and the solvent of cresol, xylene, xylol, ethylbenzene, phenol, methanol, ethanol, water, etc., the varnish W being composed of the resin component of 10–30% by weight and solvent of 70–90% by weight, and the varnish W has a viscosity of 1.0–35.0 dPa·s.

Preferably, in the device having the configuration described above, at a tip of the container in the moving direction of the electric wire, an applying die through which the electric wire is passed is attached to a die holder. In this configuration, a redundant amount of varnish is drawn out by the die holder when the electric wire is passed through the application die so that the insulating layer of the varnish having a uniform thickness is formed on the outer surface of the electric wire.

Preferably, preferably, the container is detachably attached to an attaching plate provided upright on a tray through a holder.

In this configuration, exchange and cleaning, fine adjustment of location of the container and other components the container can be easily carried out.

Preferably, the device having the configuration described above further comprises a drying furnace for drying and baking the varnish applied on the outer surface of the electric wire at the rear end of the die holder. In accordance with this configuration, the insulating layer of the varnish which is strong in structure can be formed on the outer surface of the electric wire.

In the device having the above configuration, the the flow-rate adjusting means preferably includes a dropping nozzle attached to the tip of the supply tube;

an operating knob provided outside the dropping nozzle, the inner aperture of the nozzle being adapted to be adjustable;

a nozzle holder fit in the outer surface of the dropping nozzle, and a guiding member having a ⊃ shape in section, the guiding member being slidably fit in the outside of the nozzle holder in a direction orthogonal to the moving direction of the electric wire.

In this configuration, by simply operating the operating knob, the internal aperture of the dropping nozzle can be adjusted, thereby adjusting the quantity of the varnish to be dropped toward the outer surface of the electric wire easily and surely. Further, the flow-rate adjusting means permits the vaporizing of the solvent to be suppressed and the mixing rate of the resin component to the solvent component to be maintained constant, thereby displaying the viscosity of the varnish effectively.

Since the guiding member is slidably fit in the outside of the nozzle holder in a direction orthogonal to the moving direction of the electric wire, fine adjustment of the location of the dropping nozzle can be carried out easily, surely and accurately.

The above and other objects and features of the invention will be more apparent from the following description taken in conjunction with the accompanying drawings.

DESCRIPTION OF THE PREFERRED EMBODIMENTS

Figure 1:
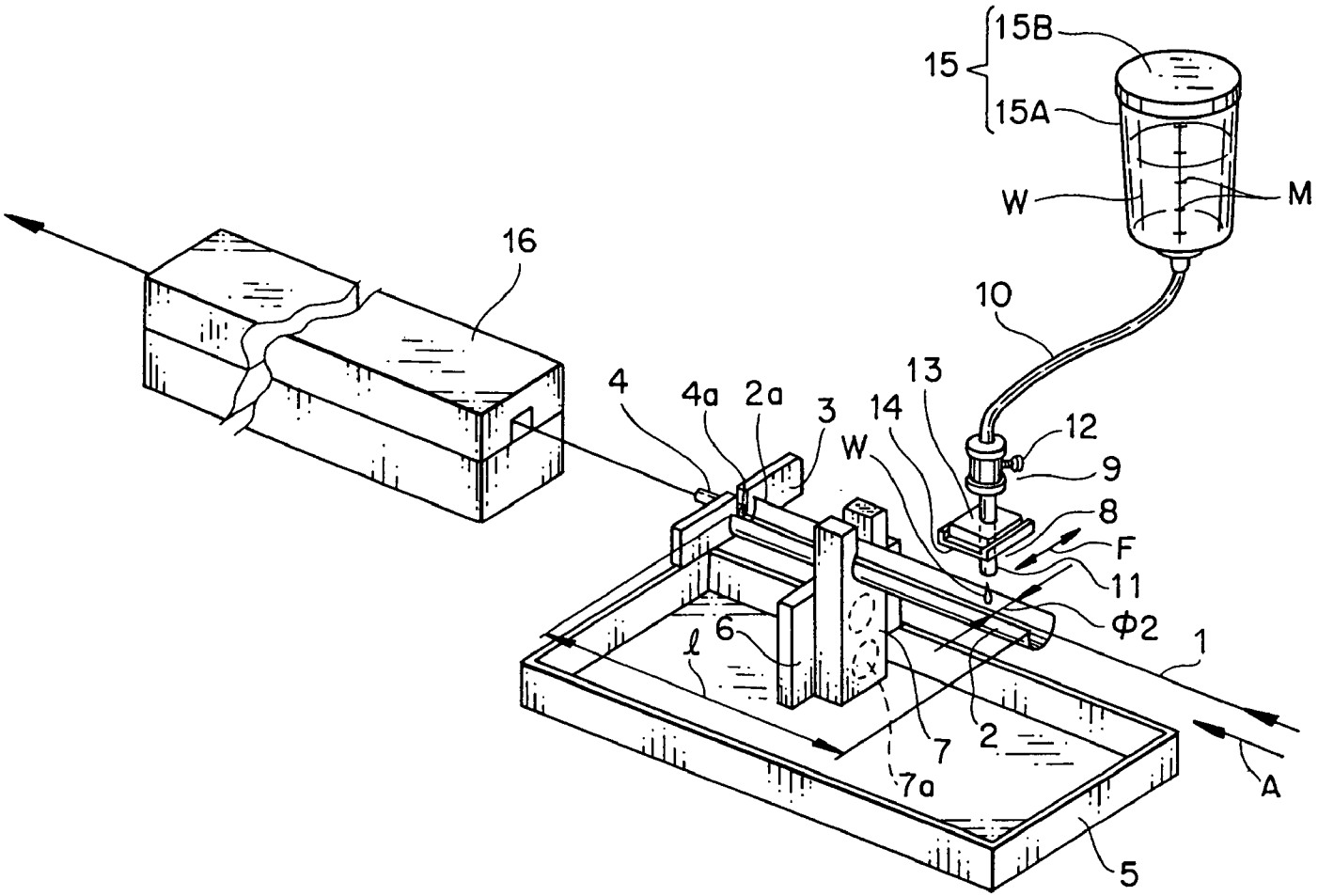
FIG. 1 is a perspective view of the first embodiment of a device for applying varnish on an electric wire according to this invention.

Now referring to the drawings, an explanation will be given of various embodiments of this invention.

Embodiment 1

Figure 2:
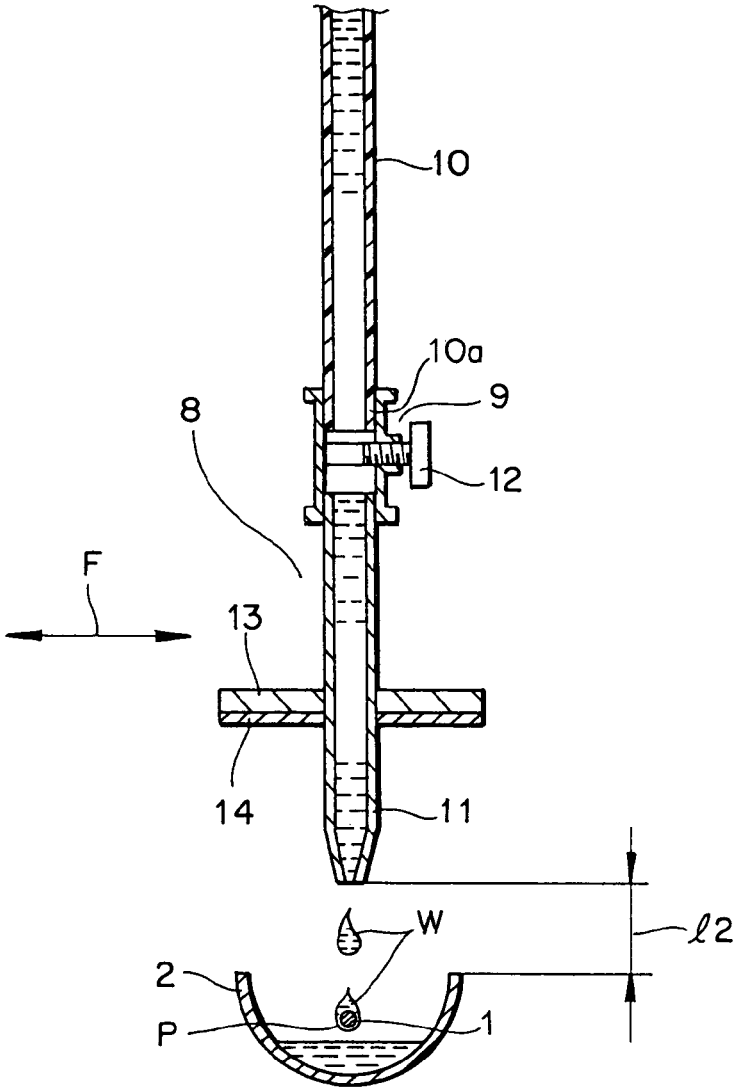
FIG. 2 is an enlarged sectional view of the state where the varnish is applied to the outer surface of the electric wire by dropping the varnish from a dropping nozzle of a dropping means according to this embodiment.
Figure 3:
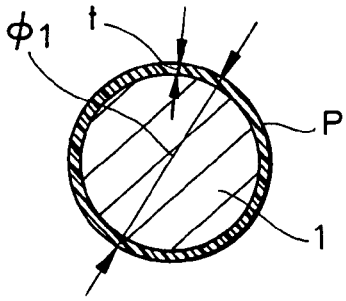
FIG. 3 is an enlarged sectional view of a typical electric wire on which an insulating layer of varnish is formed.
Figure 4:
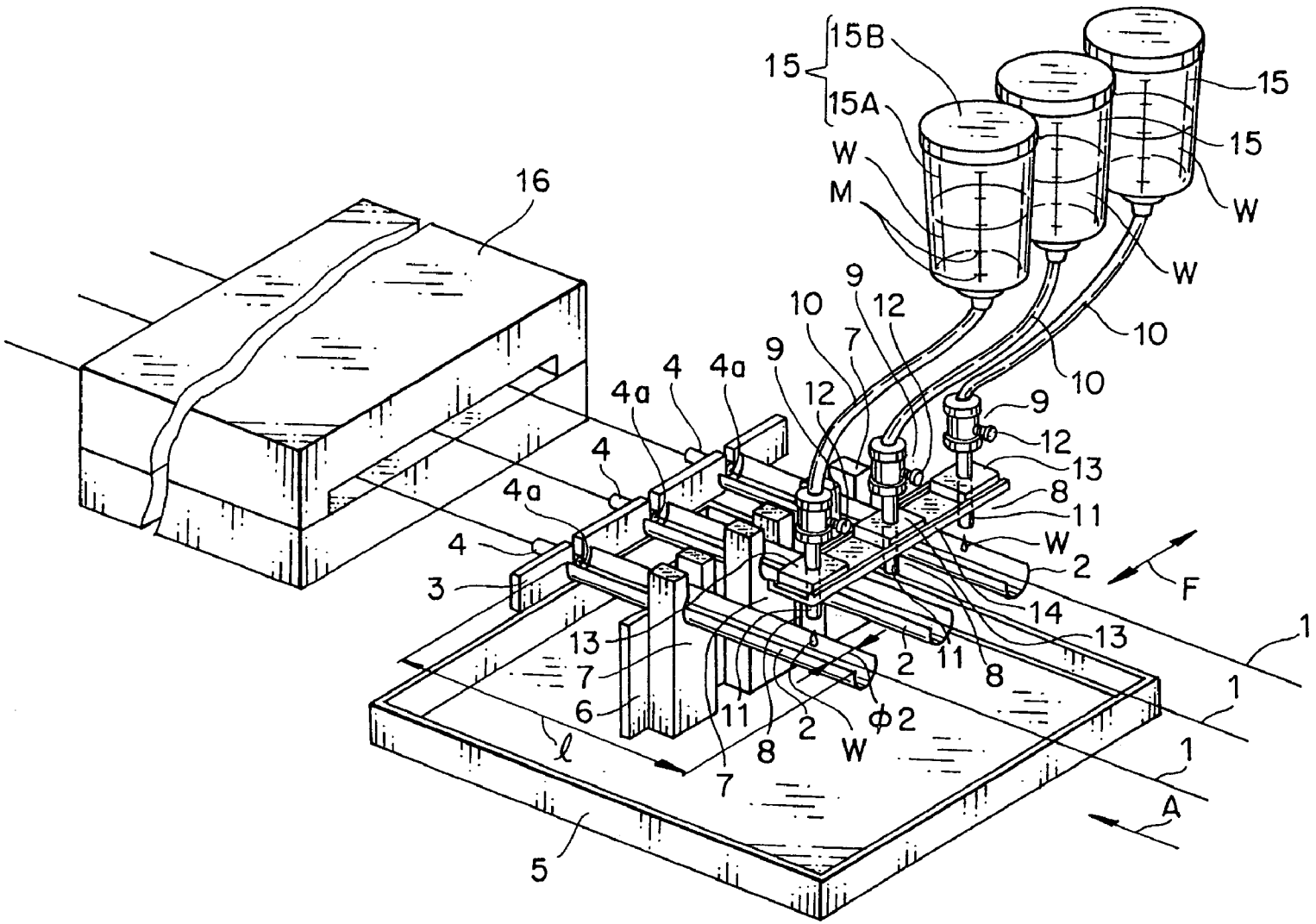
FIG. 4 is a perspective view of the first embodiment of a device for applying varnish on an electric wire according to this invention.

FIG. 1 is a perspective view of the first embodiment of a device for applying varnish to an electric wire according to this invention; FIG. 2 is an enlarged sectional view of the state where the varnish is applied to the outer surface of the electric wire by dropping the varnish from a dropping nozzle of a dropping means according to this embodiment; FIG. 3 is an enlarged sectional view of a typical electric wire on which an insulating layer of varnish is formed; and FIG. 4 is a perspective view of the second embodiment of a device for applying varnish to an electric wire according to this invention.

In FIGS. 1 to 3, reference numeral 1 denotes an electric wire which is movable at a desired speed. In this embodiment, the electric wire 1 has a circular shape in section, and a diameter of 0.01 mm–3.00 mm, preferably 0.2 mm–2.50 mm. The electric wire 1 is made of e.g. metal such as aluminum or its alloy, or iron, gold or other conductor, which exhibits good electric conductivity.

Although not shown, the electric wire 1 is supplied from the one side by rolling of a supply roller. The electric wire 1 is taken up by a take-up roller so that it is movable. In this embodiment, the moving speed of the electric wire 1 depends on its diameter $\phi$ and material of the conducting portion of the electric wire 1. For example, the moving speed is 3 m/min–120 m/min, preferably, 15 m/min–50 m/min.

If the moving speed of the electric wire 1 exceeds 120 m/min to be excessively high, as described later, the drying of the insulating layer P of the varnish W applied to the outer surface of the electric wire 1 is insufficient. In addition, the bridging/hardening of the resin component of the varnish W is insufficient, the strength is lowered. The burden for an applying die 4 described later which is to be inserted in the electric wire is increased, the thickness of the insulating layer P is uneven, and it becomes difficult to form the insulating layer P effectively and continuously.

If the moving speed of the electric wire 1 becomes lower than 3 m/min to be excessively low, the insulating layer of the varnish W applied to the outer surface of the electric wire 1 is excessively hardened, and becomes fragile in structural strength. Because of friction or shock, cracks are apt to be created and to be peeled off.

Reference numeral 2 denotes a trough-like container which is located at a lower position in a direction of arrow A (also referred to as a moving direction A). The container is arranged so as to correspond to the moving direction of arrow A for each of the electric wires 1. The container 2 can be formed by cutting the upper portion of a pipe of SUS by a width of about 4 mm into a U-shape, the pipe having an outer diameter ϕ2 of 10 mm and a length of about 100 mm. The container 2 should not be limited to the illustrated one. For example, the shape, diameter and length l of the container 2 can be freely selected taking account of the shape, diameter ϕ1 and moving speed of the electric wire 1 and density and viscosity of the varnish W which is a liquid for treatment.

Reference numeral 3 denotes a die holder to which the tip 2*a* of the container 2 is attached. The die holder 3 includes an applying die 4 in the direction of arrow A. The electric wire is passed through the application die 4. The application die 4 has a passing-through hole 4*a* the shape of which agrees to the electric wire 1 to be processed. The application die has a diameter slightly larger than that of the electric wire 1. The application die 4 is made of a flexible material such as felt, synthetic resin sponge, rubber, cloth, etc. which are available at a low price in a large quantity. While the electric wire is passed through the application die 4, a redundant amount of varnish W is drawn out by the die holder 3 so that the insulating layer P of the varnish W with a uniform thickness can be formed on the outer surface of the electric wire 1.

The container 2 is attached to an attaching plate 6, which stands on a tray 6, through a holder 7. The holder 7 can be attached to the attaching plate 6 by e.g. adsorbing the holder 7 to the attaching plate 6 using the magnetic adsorbing force of a magnet 7*a* provided on the plane of the holder 7 opposite to the attaching plate 6, or by bolting (not shown).

Reference numeral 8 denotes a dropping means which is provided so as to correspond to each electric wire 1 above the container 2 apart from the container 2 by a desired distance 12. The dropping means 8 includes a varnish containing tank 15, a varnish supplying tube 10 attached thereto, and a flow-rate adjusting device 9 which communicates with the varnish supplying tube 10. By the dropping means 8, a desired quantity of varnish W is dropped on and applied to the outer surface of the electric wire 1 through a flow rate adjusting portion 9 so that the insulating layer P of the varnish W is formed on the outer surface of the electric wire 1 (FIGS. 1 and 2).

The flow rate adjusting portion 9 includes a dropping nozzle 11 attached to the tip 10*a* of a supply tube 10 through which the varnish W is supplied (The resin component of the varnish to solvent is adjusted to have a desired density and a desired viscosity), an operating knob 12 provided outside the dropping nozzle 11, the inner aperture of the dropping nozzle 11 being adapted to be adjustable, a nozzle holder 13 which is fit in the outer surface of the dropping nozzle 11, and a guiding member 14 having a ⊃ shape in section, the guiding member 14 being slidably fit in the outside of the nozzle holder 13 in a direction orthogonal to the moving direction A of the electric wire 1. In this embodiment, the supply tube 10 is made of soft synthetic resin, rubber, or metal to exhibit flexibility.

Since the nozzle holder 13 is slidably fit in the guiding member 14 having a ⊃ shape in section in a direction F orthogonal to the moving direction A of the electric wire 1, fine adjustment of the position of locating the dropping nozzle 11 for the electric wire 1 which moves above and along the container 2 can be made surely and easily.

Reference numeral 15 denotes a tank connected to the base 10*b* of the supply tube 10. The tank 15 is a cylindrical bottomed body 15A and a cover 15B which removably covers the upper portion of the body 15A. The tank 15 is also a sealed container. By opening the cover 15B, the varnish W whose resin component to the solvent is adjusted to a desired density and a desired viscosity can be supplied into the body 15A of the tank 15.

The body 15A of the tank 15 is preferably made of e.g. transparent or semi-transparent synthetic resin or glass. This permits the quantity of the varnish contained within the body 15A to be recognized from the outside so that the remaining level of the varnish can be easily known. The graduations M are made on the side of the body 15A of the tank 15. The graduations M serve as a standard for knowing the quantity of the varnish W contained within the body 15A or the remaining level of the varnish from the outside.

By simply rotating the operating knob 12 to adjust the internal aperture of the dropping nozzle 11, the quantity of the varnish W to be supplied to the outer surface of the electric wire 1 can be easily and surely adjusted.

The varnish W is composed of the resin component which is a compound of one or two kinds of resins of e.g. polyamide, epoxy, polyimide, etc. and the solvent of cresol, xylene, xylol, ethylbenzene, phenol, methanol, ethanol, water, etc. In this embodiment, the varnish W is composed of the resin component of 10–30% by weight and solvent of 70–90% by weight. In this case, the varnish W has the resin component of 10.0–30.0% by weight and the viscosity of 1.0–35 dPa·s at the varnish liquid temperature of 20° C.–30° C.

Reference numeral 16 denotes a drying furnace located at the rear of the die holder 3. The drying furnace 16 serves to dry and bake the varnish W for the electric wire 1. The type, size, etc. thereof should not be limited. The varnish W formed on the outer surface of the electric wire by heating in the drying furnace 16 is dried and baked to form the insulating layer P which is strong in structure.

The structure of this invention has been hitherto described. An explanation will be given of the operation of this invention as well as the respective steps of the process for applying the varnish to the electric wire.

First, the electric wire 1 is supplied from a supply roller (not shown) from the one side and taken up by a take-up roller (not shown) at the other end. In this embodiment, for example, the electric wire 1 is moved at the speed of 3 m/min.–120 m/min., preferably, 15 m/min.–50 m/min.

If the moving speed of the electric wire 1 exceeds 120 m/min to be excessively high, as described later, the drying of the insulating layer P by the varnish W applied to the outer surface of the electric wire 1 is insufficient. In addition, if the bridging/hardening of the resin component of the varnish W is insufficient, the strength is lowered. The burden for an applying die 4 described later which is to be inserted in the electric wire is increased, the thickness of the insulating layer P is uneven, and it becomes difficult to form the insulating layer P effectively and continuously.

If the moving speed of the electric wire 1 becomes lower than 3 m/min to be excessively low, the insulating layer of the varnish W applied to the outer surface of the electric wire 1 is excessively hardened, and becomes fragile in structural strength. Because of friction or shock, cracks are apt to be created so that the insulating layer is peeled off.

In this embodiment, the electric wire 1 has a circular shape in section, and a diameter of 0.01 mm–3.00 mm, preferably 0.2 mm–2.50 mm. The electric wire 1 is made of e.g. metal such as aluminum or its alloy, or iron, gold or other conductor, which exhibits good electric conductivity.

By the varnish dropping means 8 located above the electric wire 1 which is moved in the moving direction, a suitable quantity of the varnish W accommodated in the tank 15 is dropped one drop by one drop through the supply tube 10 from the dropping nozzle 11 located below the flow rate adjusting portion 9. Thus, the varnish W is applied to the outer surface of the electric wire 1 which is moving in the moving direction of arrow A (FIG. 1).

By simply rotating the operating knob 12, which is attached to the flow rate adjusting portion 9 of the dropping means 8, the internal aperture of the dropping nozzle 11 is adjusted to adjust the quantity (dropping quantity) of the varnish W to be supplied from the dropping nozzle 11 and dropping speed.

The dropping quantity of the varnish W which dropped from the dropping nozzle 11 by rotation of the operating knob 12 is selectively adjusted considering various factors of density, viscosity of the varnish W, and the outer diameter ϕ1, moving speed and material of the electric wire 1.

In this embodiment, the varnish W is composed of the resin component which is a compound of one or two kinds of resins of e.g. polyamide, epoxy, polyimide, etc. and the solvent of cresol, xylene, xylol, ethylbenzene, phenol, methanol, ethanol, water, etc. In this embodiment, the varnish W is composed of the resin component of 10–30% by weight and solvent of 70–90% by weight. In this case, the varnish W has the resin component of 10.0–30.0% by weight and the viscosity of 1.0–35 dPa·s at the varnish liquid temperature of 20° C.

As shown in FIGS. 1 and 2, the nozzle holder 13 is provided to be movable in a direction F orthogonal to the moving direction A of the electric wire 1 by the guiding member 14 having a ⊃ shape in section. Therefore, by shifting the nozzle holder 13 in the direction F using the guiding member 14, the location of the dropping nozzle 11 for the electric wire 1 is accurately adjusted so that the dropping position of the varnish W can be adjusted.

When the varnish is dropped from the dropping nozzle 11 toward the electric wire 1, the varnish W soaks into the moving electric wire 1 from above to below and from front to rear. Thus, the varnish will be applied to the entire periphery of the electric wire 1.

The varnish W with the density and viscosity adjusted is accommodated within the sealed tank 1 and is exposed to the open air after it has dropped through the supplying tube 10 from the dropping nozzle 11. Therefore, the solvent whose rate adjusted to the resin component volatizes in a small quantity with passage of time. The mixing rate of the resin component to the solvent component in the varnish can be maintained approximately constant.

Thus, since the density and viscosity of the varnish W can be maintained suitably, the applicability of the varnish to the electric wire 1 can be effectively demonstrated. Accordingly, the insulating layer P which is strong in structure can be formed. In addition, since the quality of the varnish W is maintained stably, the varnish W can be uniformly applied to the electric wire 1 to have a uniform thickness of t. The insulating layer P of the varnish W provides excellent electric-insulation performance and thermal-insulation performance, thereby occurring no crack.

In accordance with the prior art disclosed in the above reference, the density and viscosity of the varnish must be measured with passage of time, and if the solvent is insufficient to provide the suitable density and viscosity of the varnish, the solvent must be supplemented to adjust the density and viscosity of the varnish W. On the other hand, in accordance with the embodiment of this invention, the labor and time required for such an operation can be minimized. The management and inspection of the varnish can be easily made and the labor and time therefor can be decreased, thereby greatly improving the production efficiency.

Beneath the electric wire 1, the trough-like container 2 is located in a moving direction A of the electric wire 1. Therefore, the varnish which has dropped from the dropping nozzle 11 but not applied to the outer surface of the electric wire 1 further drops and received by the container 2.

In this case, since the electric wire A is always moved in the moving direction A from the upstream side (right side in FIG. 1) to the downstream side (left side of FIG. 1), because of the applying force due to the movement of the electric wire 1, the varnish W dropped in the trough-like container 2 does not leak down from the upstream end of the container 2, but transferred to the lower side of the container 2, i.e. the side of the die holder 3.

In this embodiment, the trough-like container 2 is formed in a U-shape by cutting the upper portion of the a SUS pipe by a width of about 4 mm. The SUS pipe has an outer diameter ϕ2 of 10 mm and a length l of about 100 mm. The container 2 can be easily and surely manufactured and combined with the die holder 3 easily and surely.

In addition, since the container 2 is detachably attached to the attaching plate 6 located upright on the tray 5, the setting position of the container 2 for the electric wire 1 can be adjusted easily and surely. The container 2 should not be limited to the configuration as illustrated. The shape, diameter ϕ2 and length l of the container 2 can be optionally selected taking into consideration the shape and diameter ϕ1, moving speed of the electric wire 1 and the density and viscosity of the varnish W.

The die holder 3 is attached to the tip 2*a* of the container 2. The die holder 3 includes an applying die 4 in the direction of arrow A. The electric wire is passed through the application die 4. The applying die 4 has a passing-through hole 4*a* the shape of which agrees to the electric wire 1 to be processed. The applying die 4 has a diameter slightly larger than that of the electric wire 1. While the electric wire is passed through the hole 4*a*, a redundant amount of varnish W applied on the outer surface of the electric wire 1 is drawn out by the die holder 3 so that the insulating layer P of the varnish W is formed on the outer surface of the electric wire 1 to provide a uniform thickness.

In this case, in this embodiment, as described above, the electric wire 1 is moved at a moving speed is 3 m/mm–120 m/mm, preferably, 15 m/min–50 m/min. Therefore, the insulating layer P of the varnish W applied on the outer surface of the electric wire 1 is sufficiently dried. In addition, the resin component of the varnish W is sufficiently bridged and hardened. Thus, the strength of the insulating layer P is improved. Further, without giving any burden to the applying die 4 made of a flexible material such as felt, synthetic resin sponge, rubber, cloth, etc., the insulating layer P having a uniform thickness t can be effectively formed.

In the other method of applying the varnish onto the outer surface of the electric wire using the roller as described above, the varnish is excessively stirred by the roller which is rolled in the tank. Further, by the rolling of the tank, a certain amount of the varnish flies from the tank into the air, and the flown varnish sinks in the varnish in the tank again. Such behavior is performed repetitively. Unlike such a method, in the embodiment of this invention, a suitable amount of varnish W, which has dropped from the dropping nozzle 11 as described above, is immediately applied to the outer surface of the electric wire 1. This hinders the solvent of the varnish from being vaporized so that the mixing ratio of the resin component to the solvent component in the varnish is difficult to change.

Thus, the viscosity of the varnish W is maintained suitably so that the applicability of the varnish on the electric wire can be effectively shown. Since the quality of the varnish can be continuously kept, the electric-insulation and thermal insulation of the insulating layer P of the varnish is excellent.

Further, since this embodiment is different from the prior art in which the varnish is applied to the outer surface of the electric wire using the rolling roller, there does not occur a situation where the varnish is stirred by the rolling roller so that air is mixed into the varnish and air bubbles are generated. In accordance with this embodiment, therefore, no pinhole is generated in the insulating layer P of the varnish W applied to the outer surface of the electric wire 1 and hence the varnish W, i.e. insulating layer with the uniform thickness t can be formed.

The electric wire 1 with the varnish W applied to its outer surface is moved to the drying furnace 16 located at the rear of the die holder 3. The drying furnace 16 serves to dry and bake the varnish W for the electric wire 1. The varnish W formed on the outer surface of the electric wire by heating in the drying furnace 16 is dried and baked to form the insulating layer P which is strong in structure.

CONCRETE EXAMPLE 1

By rolling the supplying roller not shown so that an electric wire having an outer diameter ϕ of 1.00 mm is supplied and taking up the electric wire by the take-up reel not shown, the electric wire is moved at a speed of about 20 m/minute. By tuning the operating knob 12 of the dropping means 8, from the dropping nozzle 11, a suitable quantity of the varnish W contained in the tank 15 is dropped one drop by one drop onto the electric wire 1 which is moving in the moving direction A.

In this case, the varnish W is composed of the resin component which is a compound of one or two kinds of resins of e.g. polyamide, epoxy, polyimide, etc. and the solvent of cresol, xylene, xylol, ethylbenzene, phenol, methanol, ethanol, water, etc. In this embodiment, the varnish W is composed of the resin component of 10–30% by weight and solvent of 70–90% by weight. In this case, the varnish W has the resin component of 10.0–30.0% by weight and the viscosity of 1.0–35 dPa·s at the varnish liquid temperature of 20° C.–30° C.

In this way, the varnish W with the density and viscosity adjusted is contained within the sealed tank 15 and is exposed to the open air after it has dropped through the supplying tube 10 from the dropping nozzle 11. Therefore, a small quantity of the solvent adjusted for the resin component of the varnish W with the mixing rate as described above is vaporized with passage of time. Thus, the mixing rate of the resin component to the solvent component in the varnish can be maintained approximately constant.

The varnish dropped to the electric wire 1 is applied onto the outer surface of the electric wire 1 from above to below and from front to rear. Thus, the varnish will be applied to the entire outer surface of the electric wire 1.

Thereafter, while the electric wire 1 is passed through the passing-hole 4*a* of the application die 4, a redundant amount of varnish W is drawn out by the die holder 3 so that the insulating layer P of the varnish W with a uniform thickness can be formed on the outer surface of the electric wire 1.

In this way, since the applicability of the varnish W for the electric wire 1 can be effectively displayed, and the quality of the varnish W can be maintained stably, the varnish W with a uniform thickness t can be applied on the electric wire 1. The insulating layer P of the varnish W has an excellent electric insulation and thermal insulation, and generates no crack, pinhole, etc.

Embodiment 2

FIG. 4 shows a second embodiment of the device for applying varnish to an electric wire according to the second embodiment of this invention. In FIG. 4, like reference numerals refer to like elements in FIG. 1. In this embodiment, insulating layers P of varnish W are formed on the outer surfaces of plural electric wires 1, 1, . . . . The plural electric wires 1, 1, . . . are located so that they are movable at a predetermined speed. The device includes trough-like containers 2, 2, . . . which are located for the respective electric wires at a lower position in a moving direction of arrow A, and dropping means 8, 8, . . . which are located above the containers 2, 2, . . . so as to correspond to the electric wires 1, 1, . . . and serve to drop and apply a predetermined quantity of varnish W on the outer surface of each of the plural electric wires 1, 1, . . . . The dropping means 8, 8 are provided with flow rate adjusting portions 9, respectively. The plural electric wires 1, 1, . . . each has an outer diameter of 0.01 mm–3.00 mm, preferably 0.2 mm–1.00 mm.

The plural electric wires 1, 1, . . . are moved at a desired speed. By turning the operating knob 12 of each of the dropping means 8 located so as to correspond to the electric wires 1, 1, . . . , a suitable quantity of the varnish W contained in the tank 15 is dropped one drop by one drop onto the electric wires 1, 1, . . . which are moving in the moving direction A.

When the varnish W is dropped toward the electric wire 1, 1, . . . , the varnish W soaks into the outer surface of the moving electric wire 1 from above to below and from front to rear. The redundant varnish which has dropped from the dropping nozzle 11 of each of the dropping means 8 but not applied to the outer surface of the electric wire 1 is received by each of the containers 2, 2, . . . .

Thereafter, the electric wires 1, 1, . . . with the varnish W applied to their outer surfaces are moved to the drying furnace 16 located at the rear of the die holder 3. The drying furnace 16 serves to dry and bake the varnish W for the electric wires 1.

In this way, in this embodiment, the dropping means 8 is located above each of the electric wires 1, 1, . . . whereas the trough-like container 2 is located below each of the electric wires 1, 1, . . . . Thus, the dropping means 8 are individually provided for each of the electric wires 1, 1, . . . , which are assured by the corresponding containers. The electric wires are moved separately from one another. For this reason, where an inadvertent accident of breaking any one electric wire occurs while the varnish W is applied to the plural electric wires 1, 1, . . . , the electric wire 1 broken owing to the viscosity of the varnish 1 will not be twined around the other electric wires 1, 1, . . . .

Thus, even when any one of the electric wires 1, 1, . . . is broken inadvertently, the operation of applying the varnish to the other electric wires can be continued. Since the broken electric wire will not be twined around the other electric wires, the operating efficiency can be improved.

In this embodiment, the plural electric wires 1, 1, . . . can be moved at different moving speeds in the moving direction A. The plural electric wires 1, 1 may have different outer diameters ϕ1. The varnishes applied to the outer surfaces of the plural electric wires 1, 1, . . . may have different densities. In this embodiment, the same configuration and operation as the previous embodiment can be adopted.

CONCRETE EXAMPLE 2

By rolling the supplying rollers not shown so that plural electric wires (three wires in FIG. 4) 1, 1, . . . are supplied and taking up the electric wires by the take-up reels not shown, the electric wires are moved at desired speeds of about 15–20 m/minute in the moving direction A. By tuning the operating knob 12 of the dropping means 8 for each of the electric wires 1, 1, . . . , from each of the dropping nozzles 11, a suitable quantity of the varnish W contained in each of the tanks 15 is dropped one drop by one drop onto the electric wires 1, 1, . . . which are moving in the moving direction A.

The varnish W with the density and viscosity adjusted is accommodated within the sealed tanks 15, 15, . . . and is exposed to the open air after it has dropped through the supplying tube 10 from the dropping nozzle 11. Therefore, the solvent whose rate adjusted to the resin component volatizes in a small quantity with passage of time. The mixing rate of the resin component to solvent component in the varnish can be maintained approximately constant.

The varnishes are dropped from the dropping nozzles 11, 11, . . . one drop by one drop toward the electric wires 1, 1, and soaks into the moving electric wires 1, 1, . . . from above to below and from front to rear. Thus, the varnish will be applied to the entire outer surface of each of the electric wires 1, 1, . . . to provide a uniform thickness.

While each of the electric wires is passed through the passing hole 4*a* of the application die 4, a redundant amount of varnish W is drawn out by the die holder 3 so that the insulating layer P of the varnish W with a uniform thickness can be formed on the outer surface of the electric wire 1. The varnish W formed on the outer surface of the electric wire is dried and baked by heating in the drying furnace 16 to form the insulating layer P. The varnish W formed on the outer surface of the electric wire is dried and baked by heating in the drying furnace 16 to form the insulating layer P.

In connection with the embodiments described above, an explanation was given of the case where the insulating layer P of the varnish W is formed on the outer surface of an electric wire which is circular in section. However, the electric wire 1 should be limited to a circular shape, but may be a square shape on the outer surface of which the insulating layer P of the varnish may be formed.

What is claimed is:

1. A device for applying varnish to an electric wire comprising:

a trough like container located below the electric wire moving in a prescribed moving direction; and varnish dropping means located above the electric wire, said varnish dropping means including a tank for storing the varnish, a supplying tube which is communicated with the tank and through which the varnish is supplied and a flow-rate adjusting means for adjusting the flow-rate of the varnish to be dropped, wherein said container is detachably attached to an attaching plate provided upright on a tray through a holder, the electric wire is movable in the prescribed moving direction at a prescribed speed, and said varnish dropping means drops a desired quantity of varnish toward the outer surface of the electric wire which is moving at the prescribed speed through the flow-rate adjusting means so that an insulating layer of varnish having a uniform thickness is formed on the outer surface of the electric wire.

2. A device for applying varnish to an electric wire, comprising:

a trough-like container located below the electric wire moving in a prescribed moving direction; and varnish dropping means located above the electric wire, said varnish dropping means including a tank for storing the varnish, a supplying tube which is communicated with the tank and through which the varnish is supplied and a flow-rate adjusting means for adjusting the flow-rate of the varnish to be dropped;

wherein said flow rate adjusting means includes:

a dropping nozzle attached to the tip of said supply tube;

an operating knob provided outside the dropping nozzle, the inner aperture of the nozzle being adapted to be adjustable;

a nozzle holder fit on the outer surface of the dropping nozzle; and a guiding member having a ⊃ shape in section, said guiding member being slidably fit on the outside of the nozzle holder in a direction orthogonal to the moving direction of the electric wire, and wherein the electric wire is movable in the prescribed moving direction at a prescribed speed, and said varnish dropping means drops a desired quantity of varnish toward the outer surface of the electric wire which is moving at the prescribed speed through the flow-rate adjusting means so that an insulating layer of varnish having a uniform thickness is formed on the outer surface of the electric wire.

* * * * *